United States Patent [19]

Van Leeuwen

[11] 4,270,327

[45] Jun. 2, 1981

[54] PANEL CARRIER AND PANEL CONSTRUCTION INCORPORATING SUCH CARRIER

[75] Inventor: Paul Van Leeuwen, Kirkland, Canada

[73] Assignee: Hunter Douglas International N.V., Curaco, Netherlands Antilles

[21] Appl. No.: 961,266

[22] Filed: Nov. 16, 1978

[30] Foreign Application Priority Data

Oct. 31, 1978 [CA] Canada ..... 315365

[51] Int. Cl.[3] ..... E04B 5/52; E04C 2/42

[52] U.S. Cl. ..... 52/488; 52/484; 52/669; 52/714; 52/720; 52/762

[58] Field of Search ..... 52/74–78, 52/222, 488, 484, 669, 773, 762, 714, 720

[56] References Cited

U.S. PATENT DOCUMENTS

| | | | |
|---|---|---|---|
| 2,682,689 | 7/1954 | Helt | 52/75 X |
| 3,015,135 | 1/1962 | Dean et al. | 52/76 |
| 3,016,585 | 1/1962 | Chial | 52/78 X |
| 3,016,998 | 1/1962 | Buchmeier | 52/764 X |
| 3,182,773 | 5/1965 | Laaksonen | 52/669 X |
| 3,295,284 | 1/1967 | Tschiesche | 52/484 X |
| 3,313,075 | 4/1967 | Buchmeier | 52/222 X |

FOREIGN PATENT DOCUMENTS

| | | | |
|---|---|---|---|
| 2409709 | 9/1975 | Fed. Rep. of Germany | 52/669 |
| 1232421 | 4/1960 | France | 52/484 |
| 1141997 | 2/1969 | United Kingdom | 52/222 |

*Primary Examiner*—Alfred C. Perham
*Attorney, Agent, or Firm*—Pennie & Edmonds

[57] ABSTRACT

A panel carrier and a panel construction incorporating such carrier suitable for forming or cladding walls, ceilings, and the like. According to one aspect there is provided a carrier for panels comprising: an elongated, deformable, strip-like base; a plurality of panel engaging elements connected to and extending outwardly from the base in spaced apart relation therealong; each said panel engaging element including a pair of panel engaging prongs, the element being constructed such that the distance between the prongs of each said pair remains substantially fixed regardless of deformation or flexure occurring in those portions of the strip-like base extending between the panel engaging elements. By deforming or flexing the strip-like base in those portions between the panel engaging elements, the carrier can be made to follow the contour of the base or support to which the carrier is fixed without, at the same time, influencing the distance between the panel engaging prongs of the respective panel engaging elements. Thus, the panel engaging prongs are always capable of coming into the same secure engagement with the panels regardless of the contour of the support to which the carrier is fixed. A further aspect provides a panel construction comprising a plurality of carriers as described above, the carriers being arranged with their strip-like bases in spaced generally parallel relation with the panel engaging elements of the several carriers lying in respective straight line paths extending generally transversely to the elongated bases of the carriers. The construction includes a plurality of elongated panel members each of which lies in a respective one of the straight line paths and is engaged with the prongs of the panel engaging elements.

16 Claims, 9 Drawing Figures

PANEL CARRIER AND PANEL CONSTRUCTION INCORPORATING SUCH CARRIER

BACKGROUND OF THE INVENTION

This invention relates to a panel carrier and to a panel construction incorporating such carrier suitable for forming or cladding walls, ceilings, and the like.

The prior art has provided various types of panel constructions incorporating elongated spaced apart panels which are connected by various forms of panel carriers to a suitable support structure. Many of the panel carriers presently on the market are unduly complex and require a substantial expenditure of labour during the course of fitting the panels into place. In addition, most of the panel carriers presently in use are not suitable for fitting or attachment to support members exhibiting various degrees of curvature. Many modern building constructions call for the application of panel claddings to surfaces which are not planar; using the presently existing forms of carriers, such application may be rendered extremely difficult and may call for the personnel effecting the construction to do a great deal of on-site cutting and fitting thus increasing installation costs.

It is a principal object of the present invention to provide a carrier for panels and a panel construction incorporating such carrier which obviates the above difficulties to a large degree. It is also an object to provide an improved carrier design which can be mounted in a simple manner on various types of supports and which carrier can be manufactured very economically and fitted with a minimum degree of expense. It is also an object of the invention to provide an improved panel carrier which is suitable for use on already existing structures as during the course of renovation work, and which is also useful in conjunction with various forms of conventional types of wall or ceiling support structures.

SUMMARY OF THE INVENTION

According to one aspect of the invention, there is provided a carrier for panels comprising: an elongated, deformable, strip-like base; a plurality of panel engaging elements connected to and extending outwardly from the base in spaced apart relation therealong; each said panel engaging element including a pair of panel engaging prongs, the element being constructed such that the distance between the prongs of each said pair remains substantially fixed regardless of deformation or flexure occurring in those portions of the strip-like base extending between the panel engaging elements.

By deforming or flexing the strip-like base in those portions between the panel engaging elements, the carrier can be made to follow the contour of the base or support to which the carrier is fixed without, at the same time, influencing the distance between the panel engaging prongs of the respective panel engaging elements. Thus, the panel engaging prongs are always capable of coming into the same secure engagement with the panels regardless of the contour of the support to which the carrier is fixed.

In a further feature of the invention the prongs extend generally longitudinally of the strip-like base, with the prongs of each element extending in opposite directions relative to one another.

In a typical form of the invention, each panel engaging element extends outwardly from the strip-like base generally transversely to the base portion most closely adjacent thereto.

In one advantageous form of the invention the carrier is of generally L-shape configuration in cross-section taken through a panel engaging element and its associated base portion. The panel engaging elements preferably are disposed approximately in a common plane and the strip-like base may be curved or bent about axes transverse to its length (as during fitting of the strip-like base to a contoured support) while still retaining the generally co-planar relationship of the panel engaging elements.

In a preferred form of the invention, each panel engaging element, as seen side on, is of a generally T-shape configuration. The stem or leg of the T-shape is connected to the base strip with the opposite ends of the top of the T-shape defining the oppositely directed panel engaging prongs. Preferably, the entire carrier is formed from a relatively thin unitary sheet of material such as, for example, sheet aluminum.

In the preferred form of the invention, the panel engaging prongs each have a smoothly convexly contoured end portion to permit an inwardly curled edge portion of a panel to be snap-fitted thereover. In addition, a shoulder portion may be provided at the outer end of each prong to frictionally engage an inner surface part of the curled edge portion of the panel after it has been snap-fitted thereon thereby to provide for the secure holding of the panels on the carriers.

The carrier may include secondary panel engaging elements located intermediate the first mentioned panel engaging elements. This alternative is desirable for use in cases where the primary or main panels are relatively widely spaced apart and it is desired to insert small secondary panels therebetween to provide for a more pleasing visual effect and to hide or cover up the underlying support structures.

The invention in a further aspect provides a panel construction comprising a plurality of carriers as described above, the carriers being arranged with their strip-like bases in spaced generally parallel relation with the panel engaging elements of the several carriers lying in respective straight line paths extending generally transversely to the elongated bases of the carriers. The construction includes a plurality of elongaged panel members each of which lies in a respective one of the straight line paths and is engaged with the prongs of the panel engaging elements.

The strip-like bases may be disposed in a generally common plane as, for example, when the panel construction is used to form or clad a flat wall or a flat ceiling. In an alternative form of this aspect of the invention the strip-like bases may be curved or bent about one or more axes transverse to their length as, for example, when the panel construction is forming or cladding a curved surface or is being used to define a transition zone between a pair of surfaces which are disposed at an angle with respect to one another.

In a typical form of this aspect of the invention, the panels have inwardly curled longitudinal edges and, as described previously, the panel engaging prongs each have a smoothly convexly contoured end portion to provide a snap-fitting relation between the prong and the panel edge portion. The previously described shoulder portion at the outer end of the prong frictionally engages the inner surface part of the curled edge portion which has been snap fitted thereon to provide for secure engagement therebetween.

As noted previously, each carrier strip may include secondary panel engaging elements located intermediate the first-mentioned panel engaging elements. These secondary elements serve to retain thereon secondary panel members the latter being disposed in the spaces between the longitudinal edges of adjacent main panels. The secondary panel members are preferably located closer to the strip-like bases of the carriers than are the first-mentioned panels.

As noted previously, because of the deformable or flexible strip-like nature of the carrier base, it is a relatively simple matter to fit the carrier to the contour of the base and to attach it thereto by means of suitable fasteners, e.g. screws, nails and the like. However, in accordance with one advantageous form of connecting system, the carriers may be each supported from a respective one of a plurality of mutually parallel elongated support members, each of the latter having two parallel free longitudinal edges. Each carrier is arranged parallel to its associated support member and spaced clamping means are engaged around the longitudinal edges of the support members and engaged with the carriers to attach them to such support members.

In the following text, preferred embodiments of the invention are described in detail, merely by way of example, reference being had to the accompanying drawings.

DETAILED DESCRIPTION OF PREFERRED EMBODIMENTS

Figure 1:
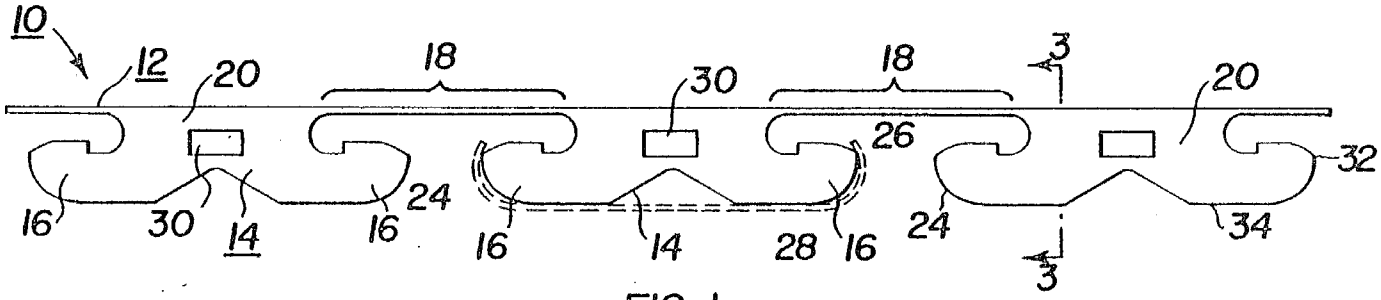
FIG. 1 is an elevation view of one embodiment of carrier construction according to the invention.
Figure 2:
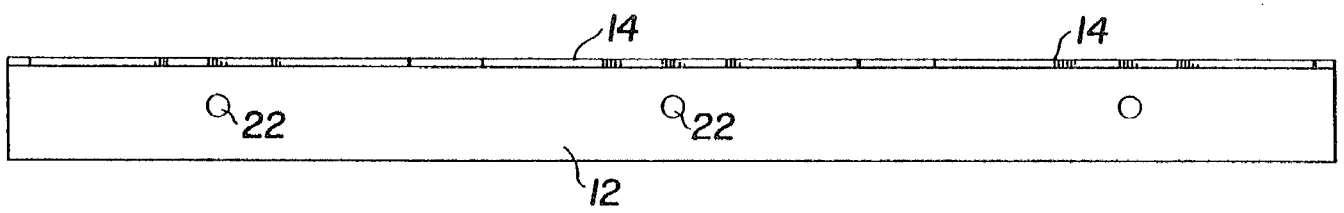
FIG. 2 is a plan view of the construction of FIG. 1.
Figure 3:
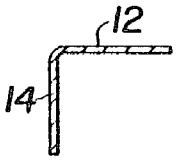
FIG. 3 is a section view taken along line 3—3 of FIG. 1.

With reference to FIGS. 1 to 3, there is shown a carrier 10 for panels which includes an elongated deformable strip-like base 12 and a plurality of panel engaging elements 14 connected to and extending outwardly from base 12 in spaced apart relation therealong. Each panel engaging element 14 includes a pair of oppositely directed panel engaging prongs 16, such prongs extending generally longitudinally relative to base 12. Because of the unitary construction of each element 14 the distance between its pairs of prongs 16 remains substantially fixed regardless of deformation or flexure occurring in those portions 18 of the strip-like base extending between the panel engaging elements 14.

As best seen in FIG. 3 the carrier 10 is of generally L-shape configuration in cross-section taken through a panel engaging element 14 and a portion of base 12 associated therewith. It will also be seen from FIGS. 2 and 3 that the panel engaging elements 14 are disposed approximately in a common plane. The elongated base 12 may be curved or bent about axes transverse to its length while still retaining the generally co-planar relationship of the panel engaging elements.

As also seen in FIG. 1, each panel engaging element 14 is of a generally T-shaped configuration. The stem or leg 20 of the T-shape is connected to the edge of the strip-like base 12 while the opposite ends of the top of the T-shape define the panel engaging prongs 16. In the embodiment shown the entire carrier 10 is formed from a relatively thin unitary sheet of material e.g. sheet aluminum. It will also be noted from FIG. 2 that the base 12 is provided with apertures 22 therein spaced apart along its length to receive suitable screws, nails, etc., for fastening the carrier to a suitable support.

With further reference to FIG. 1 it will be seen that the panel engaging prongs 16 each have a smoothly convexly contoured end portion 24 to permit an inwardly curled edge portion 26 of a panel 28 (shown in phantom in FIG. 1) to be snap-fitted thereover. Each prong 16 is also provided with a shoulder portion 32 at the extreme outer end of the prong which serves to frictionally engage the inner surface part of the curled edge portion 26 of the panel after it has been snap-fitted thereon. The inner major surface of the panel 28 rests on the straight outer edge portions 34 of the respective elements 14 thus preventing inward deflection or buckling of the major panel surfaces during use.

A further feature, as seen in FIG. 1, comprises an aperture 30 which is disposed approximately centrally of each of the main panel engaging elements 14. This aperture provides a means for engaging the carrier 10 to a special form of support structure to be described more fully hereafter with reference to FIG. 9.

Figure 5:
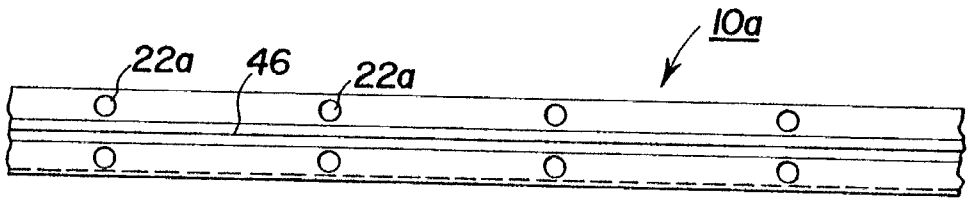
FIG. 5 is a bottom plan view of the embodiment of FIG. 4.
Figure 4:
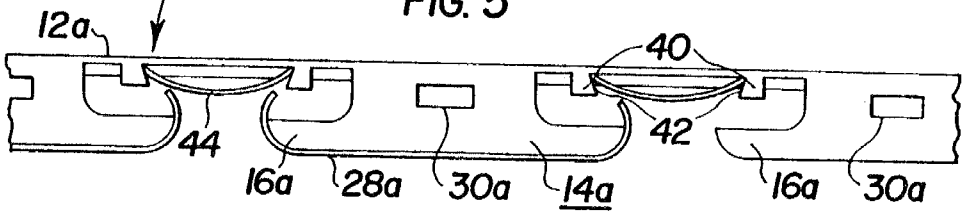
FIG. 4 is a side elevation view of a further embodiment of carrier construction according to the invention, certain panel members being shown as mounted thereon.
Figure 6:
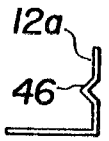
FIG. 6 is an end elevation view of the embodiment of FIG. 4.

A second embodiment of the carrier is designated by reference 10*a* in FIGS. 4, 5 and 6. The overall construction of this embodiment is similar to that described above with the following exceptions. Firstly, the carrier 10*a* includes secondary panel engaging elements 40 which are located intermediate the principal panel engaging elements 14*a*. These secondary elements 40 are relatively small in comparison with the principal panel engaging elements 14*a* and lie in a common plane therewith. The secondary elements 40 define oppositely sloping engagement surfaces 42 between which a secondary or intermediate panel element 44 may be disposed. The secondary panel elements 44 are located relatively close to the strip-like base 12 as compared to the distance between the principal panels 28*a* and the base 12*a*. These secondary or intermediate panels 44 may be conveniently made of a relatively thin elongated plastic strip which is transversely shallowly curved, such as the form of strip commonly used to form the lamellae of a venetian window blind.

A further modification as best seen in FIG. 6 involves the presence of a longitudinal ridge 46 extending lengthwise of base 12*a* approximately mid-way between its marginal edges thereby to provide base 12*a* with additional stiffness. This is particularly useful when the base 12*a* is to be attached to a straight support member at spaced intervals therealong, such ridge 46 preventing substantial dropping or flexure of the carrier 10*a* under the loads imposed thereon by the panel members 28*a* which it is supporting.

Figure 7:
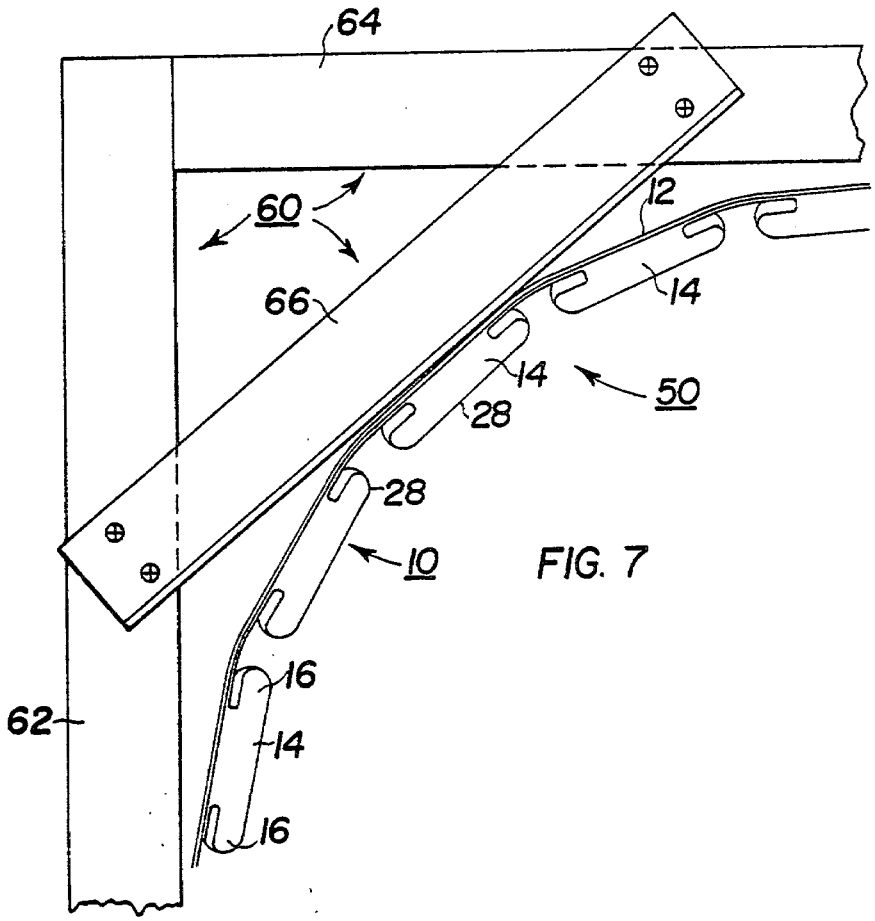
FIG. 7 is an end elevation view of a panel construction incorporating a carrier according to the invention and mounted to a support, the panel construction, as a whole, lying in a curved surface.
Figure 8:
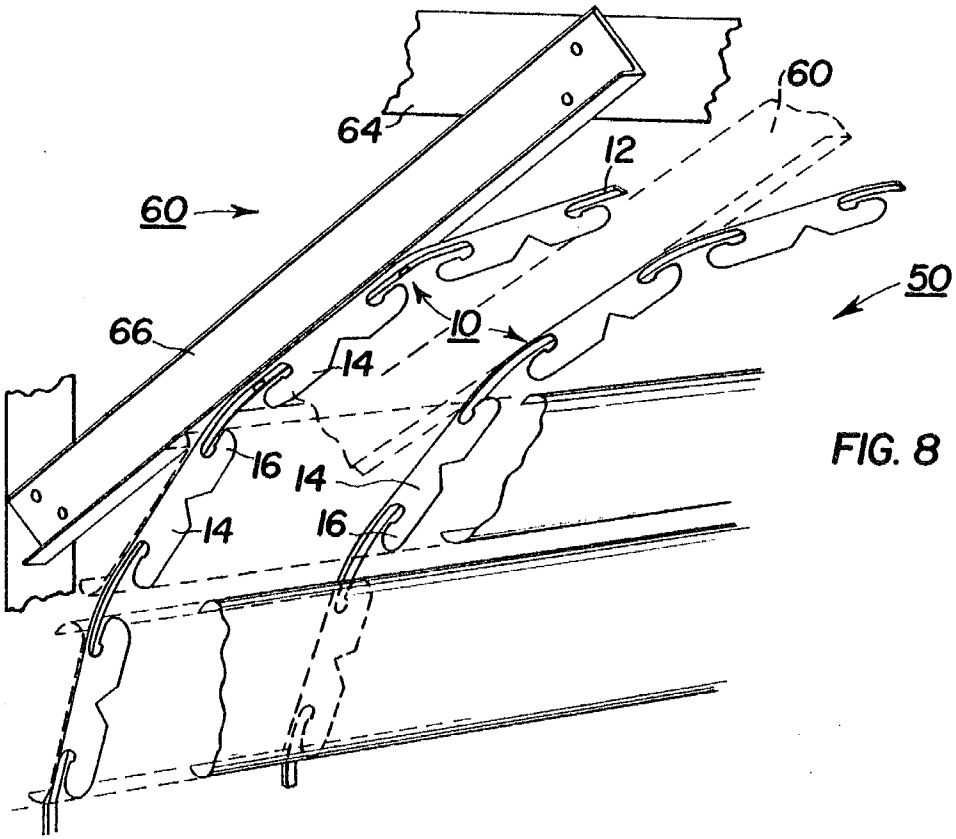
FIG. 8 is a perspective view of a panel construction essentially the same as that shown in FIG. 7 thereby to further illustrate this application of the invention and, FIG. 9 is a perspective view of a further form of a panel construction, the panels of which lie in essentially a common plane and the panel carrier being mounted to a unique form of support structure.
Figure 9:
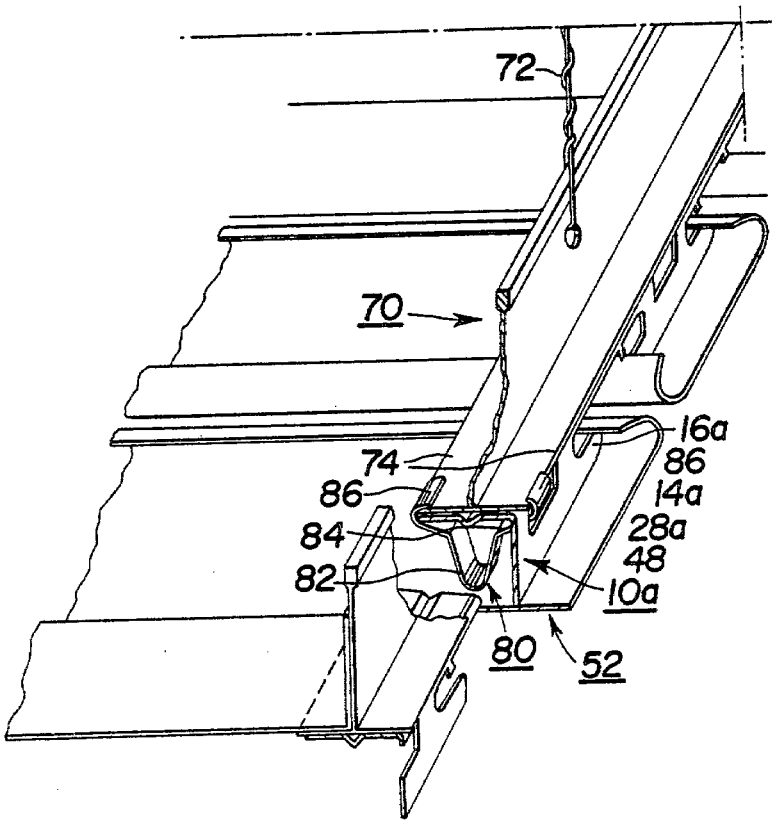

Panel constructions in accordance with the invention are shown in FIGS. 7, 8 and 9. In the embodiments of FIGS. 7 and 8, the carriers 10 are curved around such that the panels 28 supported thereby lie in a curved surface i.e. a substantially cylindrically curved surface. In the embodiment of FIG. 9, the panels 28*a* all lie in substantially a common plane.

With further reference to FIGS. 7 and 8 it will be seen that the carriers 10 are disposed with their strip-like bases 12 in spaced generally parallel relation with the panel engaging elements 14 of the several carriers lying in respective straight line paths extending generally transversely to the elongated bases 12 of the carriers. Each of the elongated panel members 28 lies in a respective one of the straight line paths and is engaged with the prongs 16 of the elements 14 in the manner described previously. With reference to FIGS. 7 and 8 it will be seen that the carriers 10 are supported from a rigid support structure 60 which, as shown, includes vertical members 62 joined to horizontally extending members 64 with an intermediate support member 66 extending therebetween and connected thereto at about a 45° angle. The carriers 10 are connected to these support members by screws with the connection between the support structure and the carrier being made adjacent every third panel engaging element 14. It will be readily seen from an inspection of FIGS. 7 and 8 that the carriers 10 may be quickly attached in place after they have been deformed to the desired contour with the panels 28 being thereafter snap-fitted into place over the oppositely directed prongs 16.

The panel construction shown in FIG. 9 has several mutually parallel support members 70, of which only one is illustrated, and which are suspended, for example, on suspension elements 72. The support members 70 each have an inverted T-shaped cross section and each support member 70 defines two parallel free longitudinally edges 74. Each carrier 10*a* extends parallel to the longitudinal axis of support member 70 in contacting relationship to the undersurface of support member 70; i.e. strip-like base 12*a* is in close juxtaposition to the lower surface of support member 70. In order to connect the carrier 10*a* to support 70, a plurality of clamps 80 are provided, spaced along the carrier 10*a*, only one of which clamps 80 is illustrated in FIG. 9. The clamp 80 includes a generally U-shaped lower portion 82 and at the outer edges of the arms of which a pair of divergent arms 84 are provided. These divergent arms 84 are provided at their free ends with inturned locking parts 86. The ends of the arms 84 and the inturned locking parts 86 form, in effect, a channel section which accommodates and engages with the edges of the base 12*a* of the carrier and the adjacent edges 74 of support 70 thereby securely holding them together. It will be readily seen from FIG. 9 that one of the divergent arms 84 and its associated locking part 86 extends through the aperture 48 provided in its associated panel support element 14*a*. The above-described clamps 80, as noted above, are provided in spaced apart relation along each of the carriers 10*a* thereby to provide the desired degree of support. It is quite apparent that connecting means other than clamp 80 may be provided to secure carrier 10*a* to support member 70; however, the clamp 80 is of simple construction and may be applied quickly and easily to the structure shown thus further reducing construction costs. A further advantage of the structure shown is that it allows the carriers 10*a* to be slid along their respective supports 70 thus permitting the panel support elements 14*a* to be easily and quickly brought into alignment with one another before the panels 28*a* are snap-fitted in place.

The panels 28, 28*a* referred to in conjunction with the previously described embodiments are, per se, of generally conventional construction and need not be described further here. They are commonly made of thin sheet aluminum and they will, of course, be coated with suitably coloured coating and decorative materials thereby to provide the desired overall visual effect. In addition, in the constructions shown in FIGS. 7 through 9, the use of intermediate or secondary panels 44 such as described in conjunction with the embodiment of FIGS. 4–6 may be employed if desired.

Those skilled in the art will realize that numerous modifications of the examples which have been described herein are conceivable without departing from the scope of the invention as hereinafter claimed.

What is claimed is:

1. A carrier for panels, the carrier capable of being secured to a support, comprising:

an elongated, generally planar strip-like base being bendable transverse to its length so as to generally follow the contour of the support; the generally planar strip-like base having connected thereto substantially a plurality of panel engaging elements connected to and extending outwardly from the base in spaced apart relation therealong; each said panel engaging element including a pair of panel engaging prongs, the panel engaging elements being disposed substantially in a common plane, each panel engaging element being so constructed that the distance between the prongs of each said pair remains the same and the engaging elements of the carrier remain generally co-planar when said base is bent.

2. The carrier according to claim 1 wherein said prongs extend generally longitudinally of the base, with the prongs of each element extending in opposite directions relative to each other.

3. The carrier according to claim 2 wherein each panel engaging element extends outwardly from the strip-like base generally transversely to the base portion most closely adjacent thereto.

4. The carrier according to claim 2 wherein the carrier is of generally L-shape configuration in cross-section taken through a panel engaging element and its associated base portion.

5. The carrier according to claim 2, 3 or 4 wherein each panel engaging element is of a generally T-shape configuration, the stem or leg of the T-shape being connected to the base and the opposite ends of the top of the T-shape defining said oppositely directed panel engaging prongs.

6. The carrier according to claim 2, 3 or 4 wherein each panel engaging element is of a generally T-shape configuration, the stem or leg of the T-shape being connected to the base and the opposite ends of the top of the T-shape defining said oppositely directed panel engaging prongs, wherein the entire carrier is formed from a relatively thin unitary sheet of material.

7. The carrier according to claim 2, 3 or 4 wherein each panel engaging element is of a generally T-shape configuration, the stem or leg of the T-shape being connected to the base and the opposite ends of the top of the T-shape defining said oppositely directed panel engaging prongs, wherein the entire carrier is formed from a relatively thin unitary sheet of material and wherein the panel engaging prongs each have a smoothly convexly contoured end portion to permit an inwardly curled edge portion of a panel to be snap-fitted thereover, and a shoulder portion at the outer end of the prong to frictionally engage an inner surface part of the curled edge portion of the panel after it has been snap-fitted thereon.

8. The carrier according to claim 1, 2 or 4 further including secondary panel engaging elements located intermediate the first mentioned panel engaging elements.

9. The carrier according to claim 1, 2 or 4, further including a ridge on said base and extending lengthwise thereof to impart stiffness thereto.

10. The carrier according to claim 1, 2 or 4 wherein selected ones of said elements have an aperture therethrough to enable a portion of a support clamp to pass therethrough for affixing the carrier to a support structure.

11. A panel construction comprising a plurality of carriers each as defined in claim 1, 2 or 4, said carriers being arranged with their strip-like bases in spaced generally parallel relationship with the panel engaging elements of the plurality of carriers lying in respective straight line paths extending generally transversally to the elongated bases of the carriers, and a plurality of elongated panel members, each of which lies in a respective one of said straight line paths and is engaged with the prongs of the panel engaging elements disposed in such straight line path.

12. A panel construction comprising a plurality of carriers each as defined in claim 2, 3, or 4 said carriers being arranged with their strip-like bases in spaced generally parallel relationship with the panel engaging elements of the plurality of carriers lying in respective straight line paths extending generally transversally to the elongated bases of the carriers, and a plurality of elongated panel members, each of which lies in a respective one of said straight line paths and is engaged with the prongs of the panel engaging elements disposed in such straight line path and wherein said strip-like bases are disposed in a generally common plane.

13. A panel construction comprising a plurality of carriers each as defined in claim 2, 3 or 4, said carriers being arranged with their strip-like bases in spaced generally parallel relationship with the panel engaging elements of the plurality of carriers lying in respective straight line paths extending generally transversely to the elongated bases of the carriers, and a plurality of elongated panel members, each of which lies in a respective one of said straight line paths and is engaged with the prongs of the panel engaging elements disposed in such straight line path, and wherein the bases are curved or bent about one or more axes transverse to their lengths.

14. A panel construction according to claim 12 wherein the panels have inwardly curled longitudinal edges and the panel engaging prongs each have a smoothly convexly contoured end portion to provide the inwardly curled edge portion of the panel with a snap-fitting relation therebetween, and a shoulder portion at the outer end of the prong which frictionally engages the inner surface part of the curled edge portion which has been snap-fitted thereon.

15. The panel construction of claim 14 wherein the longitudinal edges of adjacent panels are spaced apart, each carrier strip including secondary panel engaging elements located intermediate the first mentioned panel engaging elements and retaining secondary panel members thereon, the latter being disposed in the spaces between the first mentioned panel and being located closer to the strip-like bases of the carrier than are the first mentioned panels.

16. A panel construction comprising a plurality of carriers each as defined in claim 2, 3 or 4, said carriers being arranged with their strip-like bases in spaced generally parallel relationship with the panel engaging elements of the plurality of carriers lying in respective straight line paths extending generally transversally to the elongated bases of the carriers, and a plurality of elongated panel members, each of which lies in a respective one of said straight line paths and is engaged with the prongs of the panel engaging elements disposed in such straight line path, and wherein said carriers are each supported from a respective one of a plurality of mutually parallel elongated support members, each of the latter having two parallel free longitudinal edges, each carrier extending parallel to its associated support member, spaced clamping means engaged around the longitudinal edges of the support members and engaged with the carriers to attach them to the support members.

* * * * *